US006357057B1

(12) United States Patent
Krist

(10) Patent No.: US 6,357,057 B1
(45) **Date of Patent: *Mar. 19, 2002**

(54) CLEANING AND HYGIENIC DEVICE

(76) Inventor: Robert Stephen Krist, 121 Holy Cross Pl., Kenner, LA (US) 70065

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/017,452

(22) Filed: Feb. 2, 1998

Related U.S. Application Data

(63) Continuation-in-part of application No. 08/551,630, filed on Nov. 1, 1995, now Pat. No. 5,720,055.

(51) Int. Cl.[7] ..... A47K 3/22; E03C 1/06; E03D 9/08

(52) U.S. Cl. ..... 4/420.4; 4/444; 4/448; 4/666; 4/255.06

(58) Field of Search ..... 4/420.1–420.5, 4/340–342, 443, 444–448, 666, 255.06; 239/587.4, 391, 397

(56) References Cited

U.S. PATENT DOCUMENTS

| | | | | | |
|---|---|---|---|---|---|
| 1,818,388 | A | | 8/1931 | Farley | |
| 2,036,985 | A | | 4/1936 | Salvoni | 4/7 |
| 2,754,820 | A | * | 1/1956 | Gluck et al. | 4/420.1 |
| 2,985,385 | A | * | 5/1961 | Bowers et al. | 239/587.4 |
| 3,057,561 | A | * | 10/1962 | Corlett, Jr. | 239/587.4 |
| 3,882,864 | A | * | 5/1975 | Montgomery | 4/42.1 |
| 4,000,742 | A | | 1/1977 | Diglacomo | 128/229 |
| 4,287,618 | A | | 9/1981 | Silver | 4/443 |
| 4,326,308 | A | | 4/1982 | Silver | 4/420 |
| 4,510,630 | A | | 4/1985 | Osgood | 4/443 |
| 4,596,058 | A | | 6/1986 | Nourbakhsh | 4/448 |
| 4,622,704 | A | | 11/1986 | Chung | 4/443 |
| 4,764,997 | A | | 8/1988 | Anderson et al. | 4/420 |
| 5,023,961 | A | | 6/1991 | Alonso | 4/443 |
| 5,067,186 | A | * | 11/1991 | Ayers | 4/420.3 |
| 5,263,205 | A | * | 11/1993 | Leunissen | 4/420.4 |
| 5,272,774 | A | * | 12/1993 | Ivko et al. | 4/420.2 |
| 5,295,274 | A | | 3/1994 | Daniels et al. | 4/443 |
| 5,384,919 | A | * | 1/1995 | Smith | 4/420.4 |
| 5,419,363 | A | | 5/1995 | Robinson | 137/360 |
| 5,503,633 | A | * | 4/1996 | Saunders et al. | 4/340 |
| 5,659,901 | A | * | 8/1997 | Derakhshan | 4/420.1 |

FOREIGN PATENT DOCUMENTS

| | | | | |
|---|---|---|---|---|
| DE | 879079 | * | 6/1953 | 4/420.4 |

* cited by examiner

*Primary Examiner*—Charles R. Eloshway
(74) *Attorney, Agent, or Firm*—Garvey, Smith, Nehrbass & Doody LLC

(57) ABSTRACT

An improved cleaning device which can be used as a personal hygienic unit, as a unit for cleaning a diaper area of an infant, and rinsing soiled diapers, or as a cleaning unit for clearing clogs in a toilet or drain pipe. There is included a flexible hose which is connected to a water supply and to an inlet of a flow control valve. An outlet of the flow control valve is connected to a rigid hollow handle for delivery of water through the handle to a spray head rotationally secured to the handle so as to deliver water upwardly from the spray head openings when the device is in use. A secondary unit is independently connected to a water supply for delivery of water to a hand-held spray nozzle to allow cleaning of a diaper area of an infant and rinsing soiled diapers. The improved device incorporates an improved mounting assembly for facilitating the placement of the device on a toilet, and other features to provide efficient operation of the improved device.

10 Claims, 11 Drawing Sheets

CLEANING AND HYGIENIC DEVICE

CROSS-REFERENCE TO RELATED APPLICATIONS

This is a continuation-in-part application of U.S. patent application Ser. No. 08/551,630, filed Nov. 1, 1995 by the same inventor, which has issued as U.S. Pat. No. 5,720,055, incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

This invention relates to cleaning devices, and, more particularly, to an attachment for water closets which can be used as a bidet, as a cleansing device for babies, their soiled diapers, and a device for clearing clogged toilets and drains.

2. General Background of the Invention

The advantages of bidet bathroom fixtures and sitz baths are well recognized in the art of therapeutic hygienic cleaning. Generally, bidet fixtures are mounted separately from toilet bathroom fixtures and require separate plumbing for proper operation. The disadvantage of such a separate fixture is that it necessarily occupies a space in an often limited confines of a modern bathroom and, in many cases, becomes cost prohibitive. To solve the problem, numerous patents have been issued for attachments for water closets which could serve as bidet, or personal cleaning devices, or which can be doubled as a sitz bath, when necessary. Examples of such attachments can be found in a number of U.S. patents, some of which are listed below:

| | | | | |
|---|---|---|---|---|
| 1,818,388 | 2,036,985 | 4,000,742 | 4,287,618 | 4,326,308 |
| 4,510,630 | 4,596,058 | 4,622,704 | 4,764,997 | 5,023,961 |
| 5,295,274 | 5,384,919 | 5,419,363 | | |

Some of these devices disclose the use of hand-held shower heads mounted on a handle which also carries an actuating control valve. Others suggest the use of a showerhead with a rigid handle which is connected to a conventional faucet to allow delivery of water to the showerhead and facilitate personal cleansing of a person seated on a toilet. Still others suggest the use of specially adapted toilet seats to accommodate a showerhead with a nozzle that is supported under the toilet seat to direct the water upward. However, none of the above mentioned devices provides for the use of a hygienic device that can be also used to facilitate clearing of drainage clogs or a device that can be used during diaper changes of a baby. Furthermore, none of these other devices is capable of delivering a non-invasive enema or colonic.

BRIEF SUMMARY OF THE INVENTION

It is, therefore, an object of the present invention to provide a personal hygienic device which can be connected to conventional water plumbing fixtures and utilized for cleansing of an infant.

It is another object of the present invention to provide a device which can be used for clearing drain clogs in a toilet or in bathroom drains.

It is a further object of the present invention to provide a hand-held personal hygienic device which can be easily connected to commercial bathroom fixtures without requiring expensive separately standing structures.

It is an object of the present invention to provide improved mounting assemblies for the hand-held personal hygienic device for facilitating easy and efficient mounting of the assembly onto an existing water line into a toilet.

These and other objects of the present invention are achieved through a provision of a cleaning device which comprises an elongated flexible tubing, one end of which is adapted for connection to a source of water supply. A fluid control valve is secured to one end of the tubing to regulate the flow of water through the tubing. A rigid hollow handle is secured to an outlet of the flow control valve, the handle carrying a vented spray nozzle at its free end, with the spray nozzle provided with a plurality of openings. A connecting member retains the spray nozzle at an acute angle in relationship to a longitudinal axis of the handle so as to direct a flow of water exiting through the openings upwardly when the cleaning device is in use.

The handle is long enough to extend from an outside confines of a toilet bowl to a location immediately above the toilet bowl. When the device is in use, the control valve appears on the outside of the toilet bowl, in front of the user seated on the toilet bowl.

An open front or optional modified toilet seat is provided with a curved cutout in its top upper surface to accommodate the handle which rests in the cutout or opening when the device is in use. A sealing gasket is secured to the underside of the toilet seat to seal the parameter of the toilet seat and close the area between the top rim of the toilet bowl and the underside of the toilet seat, thereby preventing escape of water from the toilet bowl.

An alternative embodiment of the cleaning device in accordance with the present invention provides for the use of a cleaning attachment suitable for clearing clogged drain outlets. This attachment unit comprises a length of flexible tubing made from for example plastic or rubber so as to bring an open free end of the tubing to an immediate proximity of the clogged opening and deliver a stream of water through the drain outlet to thereby facilitate clearing of the toilet or drain pipe.

A further alternative embodiment of the cleaning device in accordance with the present invention provides for the use of a secondary cleaning unit suitable for cleaning a diaper area of an infant. The secondary unit provides for the use of an elongated hose independently connected to a source of water supply and provided with a spray nozzle on the free end of the hose. A spring operated manual depressible lever regulates the flow of water exiting the openings in the sprayer to clean the infant and rinse the soiled diaper.

An optional open top housing in the form of a basket with openings or slots is provided for use with the secondary unit. The housing, or basket, is dimensioned to be seated over the toilet bowl and engage with its rim the inside parameter of the toilet seat or the top rim of a toilet bowl. The user positions an infant into the basket and, while holding the infant with one hand, directs the spray of water through the hand-held spray head onto the diaper area and afterward onto the diaper which is rinsed in the basket.

The cleaning device in accordance with the present invention provides and inexpensive, versatile alternative to cumbersome bathroom fixtures currently known in the industry.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 4:
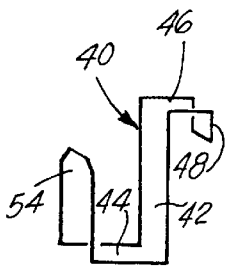
FIG. 4 is a detail view of a support bracket suitable for mounting the device on a water closet tank.

Referring now to the drawings in more detail, numeral 10 designates the cleaning device in accordance with the present invention. The device 10 comprises a hand-held personal hygiene attachment unit 12 which is connected to a dual outlet water supply valve 14 by a flexible elongated tubing 16. The tubing 16 can be made from plastic or spiral metal hose. The tubing 16 is made from a heat transferable material, such as metal or plastic, in particular, the tubing structure is simply to rigidly support the spray head. It is preferred that a collar 17 is placed over at least a portion of the tubing 16 so as to minimize discomfort of contact with cold metal part by the body of the user. The collar 17 is shown schematically in FIGS. 1, 5, and 8. The unit 12 is comprised of an elongated tubular rigid hollow handle 18 having an inlet portion, connected to an outlet 20 of a control valve 22, and an outlet portion, provided with a standard annular fitting connector 24. Detachably connected to the fitting 24 is a shower spray head 26 which is secured to the fitting 24 by a curved elbow joint 28 which allows to retain the shower spray head 26 at an acute angle in relationship to a longitudinal axis of the handle 18.

Mounted in a surrounding relationship over at least a part of the handle 18 is a grip portion 30 made from a resilient flexible material, for example rubber, to facilitate convenient frictional engagement of the handle by the user.

Figure 1:
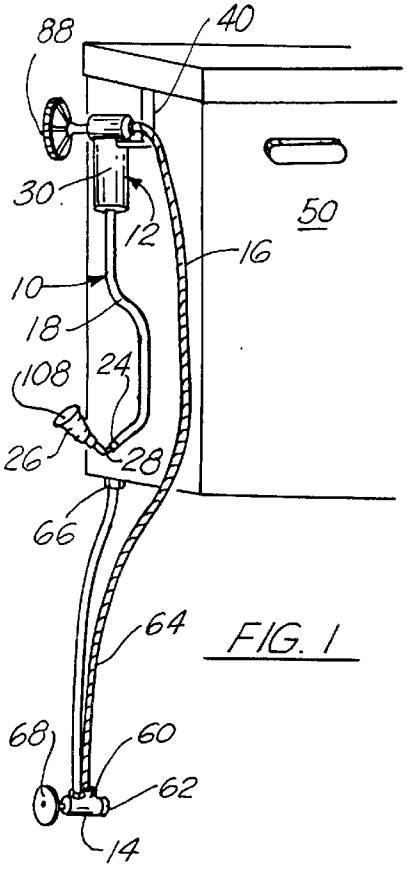
FIG. 1 is a perspective view of the device in accordance with the present invention mounted on a tank of a water closet.

As can be seen in FIGS. 1 and 4, the valve body 32 of the control valve 22 is removably supported on a J-shaped bracket 40 which is comprised of an elongated narrow plate 42 provided with transverse extensions 44 and 46. Extension 46 is unitarily attached to the upper end of the plate 42, while the extension 44 is unitarily attached to the lower end of the plate 42. The length of the extension 46 is slightly greater than the thickness of a conventional toilet tank wall to allow positioning of the extension 46 on the top edge of the toilet tank, such that the underside of the extension 46 contacts the upper edge of the tank wall.

A downwardly extending lip 48 is oriented at a right angle to the extension 46 and descends inside the toilet tank 50 to prevent disengagement of the bracket 40 from the tank 50. The length of the extension 44 is sufficient to support a bottom wail 52 of the flow control valve 22 when the unit 12 is positioned in the bracket 40. Securely connected to the extension 44 is a second vertical plate 54 which is oriented in a substantially parallel relationship to the first vertical plate 42 and prevents sliding of the unit 12 from the extension 44 when the unit 12 is supported by the bracket 40.

In such cases where the toilet tank has a flushing handle on a side of a toilet tank, it is preferred that the bracket 40 be mounted on a wall adjacent the toilet tank so as not to interfere with the normal operation of the lavatory. In that case, it is possible to have extension 46 rest on some outwardly projecting member associated with the wall mount and be disengageable therefrom when required.

As can be further seen in FIG. 1, the conventional dual outlet water supply valve 14 is provided with a second outlet 60 which receives a water flow from the inlet end 62 of the valve 14. A flexible tubing 64 is connected to the outlet 60 at one of its ends and to control valve 22 of the toilet tank 50. A control handle 68 allows to control the water flow from a municipal water supply through the valve 14 to the device 10 and to the toilet tank 50.

Figure 2:
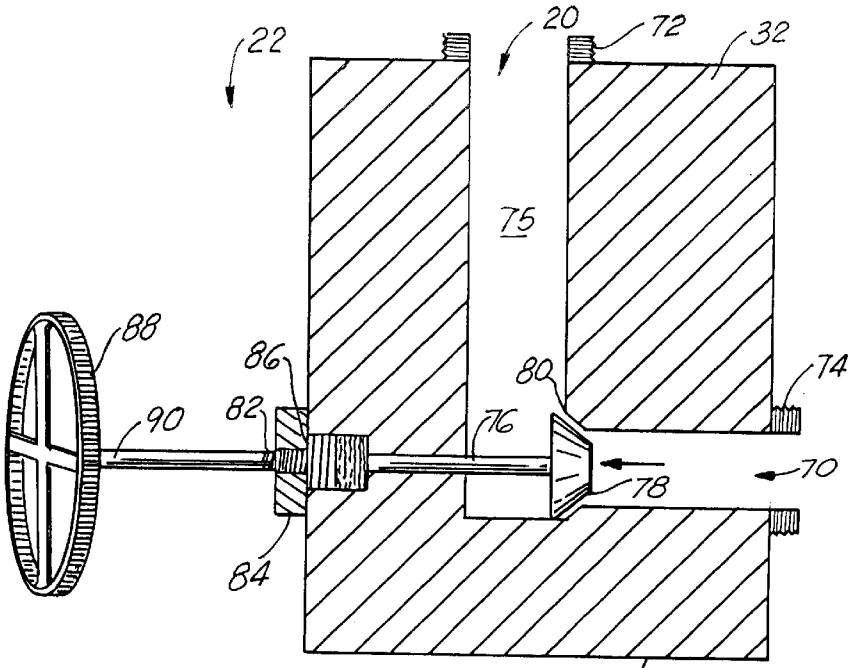
FIG. 2 is a perspective, partially cross sectional view of a flow control valve of the device in accordance with the present invention.

Turning now to FIG. 2, the flow control valve 22 in accordance with the present invention is shown to comprise the valve body 32 provided with an outlet orifice 20 and an inlet orifice 70. Both the inlet and outlet orifices are provided with conventional externally threaded annular connectors 72 and 74, respectively, to allow connection of matchingly threaded tubing connectors to the inlet and outlet of the valve 22. Of course the connectors 72 and 74 can be made as female members or a combination of one male and one female member. An internal conduit 75 is formed inside the body 32 in fluid communication between the inlet orifice 70 and the outlet orifice 20. The conduit 75 is formed as an L-shaped channel within which a shaft 76 moves in a sliding reciprocating relationship.

A lug 78 is carried by one end of the shaft 76. The plug 78 is shaped and sized to seat against a conical seat 80 within the conduit 75 and block the passageway connecting the inlet 70 and the outlet 20. The plug 78 is formed with matchingly tapered exterior wall to snugly fit against the seat 80 and terminate the fluid flow from the inlet 70 to the outlet 20 when the valve is closed.

The sliding shaft 76 is threadably engaged, such as by threads 82, within an internally threaded annular bushing 84 which is carried by the valve body 32. The shaft 76 extends through an opening 86 formed in the side of the valve body 32 opposite the inlet orifice 70. A handle 88 is carried by a free end 90 of the shaft 76, the handle 88 allowing to regulate the amount of flow traveling from the inlet 70 to the outlet 20. As the handle 88 is secured in close proximity to the handle 18 of the unit 12 the user can conveniently regulate the flow of water traveling through the spray nozzle 26 during operation of the device 10.

If desired, the spray nozzle head 26 can be provided with a suitable vent 27, as well as a keyed fitting to prevent the elbow joint 28 from turning out of its set position during operation of the device.

Figure 3:
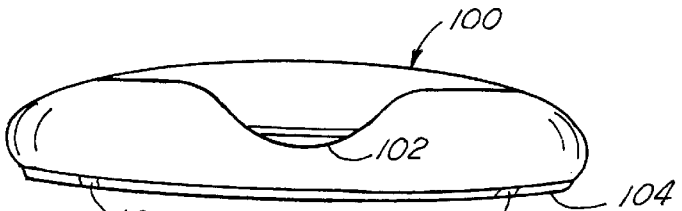
FIG. 3 is a front view of a modified toilet seat designed to accommodate a hand-held spray nozzle of the device in accordance with the present invention.

Turning now to FIG. 3, the modified toilet seat to be used with the cleaning device 10 is illustrated. The toilet seat 100 is provided with an indentation 102 in its front top surface to accommodate the handle 18 when it is positioned above the toilet bowl (not shown) before operation of the device. A peripheral gasket 104 is secured about the periphery of the underside of the seat 100 to close the gap between the seat 100 and the top rim of a toilet bowl. One or more air vents 106 are formed in the gasket 104*s* can be better seen in FIG. 3. The gasket 104 can be made from a flexible resilient material, such as plastic or rubber, and can be glued to the bottom of an existing toilet seat or manufactured as part of a modified toilet seat shown in FIG. 3. The gasket 104 prevents water from escaping the confines of the toilet bowl during operation of the device.

During use, the device 10 is removed from its position on the bracket 40 and the handle 18 is inserted in the indentation 102 on the seat 100 of a toilet bowl. The spray head 26 is oriented with its opening 108 in such a manner that the water flow is directed upwardly when the control valve 22 is in an open position. Since the control valve 22 will extend directly in front of the user when he or she is seated on the toilet seat 100, the regulation of the flow of water can be easily accomplished. The unit 12 will serve as a personal hygienic cleaning device or as a bidet for the user when the spray nozzle attachment 26 is engaged with the handle 18.

Figure 5:
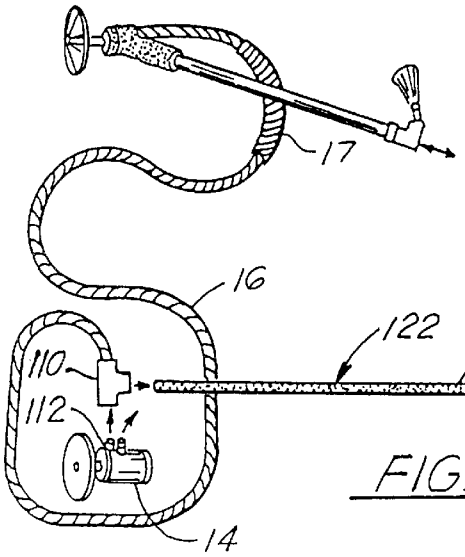
FIG. 5 is an alternative embodiment of the hygienic device in accordance with the present invention provided with a spray head nozzle suitable for use during diaper changes.
Figure 6:
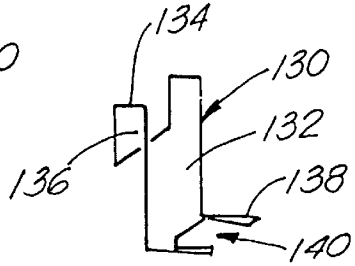
FIG. 6 is a detail view showing a support bracket for the spray head suitable for use during diaper changes.

When it becomes necessary to use the cleaning device 10 for cleansing a baby during a diaper change, the device 10 provides for the use of an alternative embodiment shown in FIG. 5. In this embodiment, a T-connector 110 is secured to one of the outlets 112 of the outlet valve 14. The connector 110 connects a second flexible hose 114 to the outlet 112, while another tubing 16 is connected to its second outlet. The remaining open outlet allows connection of a hose to supply water to the toilet tank. The hose 114 carries a hand-held spray head, or attachment 116 which is comprised of an elbow-shaped spray head formed with a plurality of spray openings 118 formed in one end of the spray head 116. A spring operated lever 120 is carried by the spray head 116 to allow for precise regulation of the amount of water delivered through the openings 118 when the attachment 116 is in use.

A separate bracket 130 is provided for supporting the attachment 116 on the toilet tank 50. The bracket 130, similar to the bracket 40, is comprised of an elongated narrow plate 132 having a transverse extension 134 which is designed to rest on the top rim of the toilet tank 50. A downwardly extending plate 136 prevents disengagement of the bracket 130 from the tank 50. A second horizontal extension 138 is provided with an irregularly-shaped opening 140 which is designed to accommodate the spray head 116 and retain it in a secure position within the bracket 130 when the unit 116 is not in use.

In order to safely hold the infant above the toilet bowl, the present invention contemplates provision of an optional infant basket 142 which has an upper rim 144 extending transversely to the body 146 of the basket 142. The rim 144 is of a diameter greater than the opening 148 in the toilet seat 100 so as to allow retention of the basket 142 above the toilet bowl when an infant is placed in the basket 142. A pair of handles 150 are secured on opposite sides of the basket body 146 to facilitate positioning and removal of the basket 142, when in use.

In operation, the user places the baby into the chamber 152 which is defined by the interior wall of the basket body 146. It is preferred that the body 146 be formed with slots or openings to allow escape of water and debris from the interior chamber 152 during use of the basket 142. Holding the infant with one hand, the user picks up the unit 122 from the bracket 130. While holding the spray head 116, the user pushes on the lever 120 to allow water to escape through the openings 118 and cleanse the diaper area of the infant. After the infant has been attended to, the soiled diaper and the basket 152 can be rinsed of debris using the unit 122.

Figure 8:
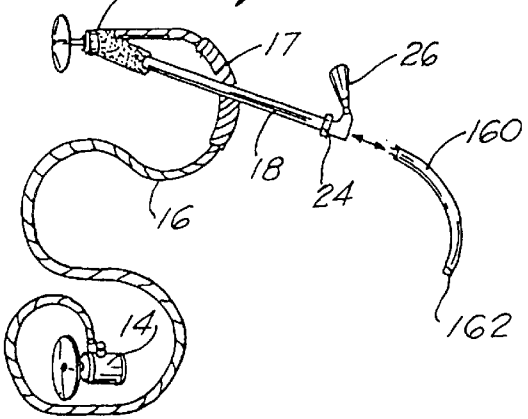
FIG. 8 is a perspective view of a third embodiment of the device in accordance with the present invention utilizing an attachment for clearing drainage clogs.
Figure 9:
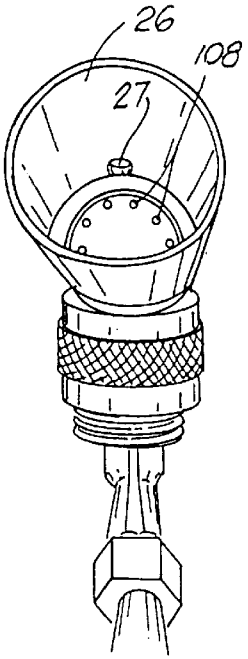
FIG. 9 is a perspective detailed view of the shower spray head for use in the present invention.
Figure 7:
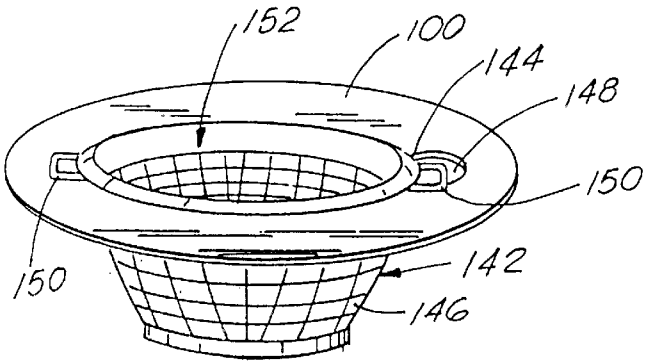
FIG. 7 is a perspective view of a basket suitable for accommodating an infant during a diaper change.

Turning now to FIG. 8, the third embodiment of the device in accordance with the present invention is illustrated. The third embodiment provides for the use of a detachable, flexible extension tubing 160 which can be secured to the attachment ring 24 at one of its ends as a substitute for the spray nozzle assembly 26. The tubing 160 has an open free end 162 which delivers a flow of water from the handle 18 when the valve 22 is in an open position. It is preferred that the tubing 160 be made from a flexible, bendable material to allow directing of a water flow in a narrow, strong flow to a drain opening of a sink, toilet, bathtub, or shower. The flow of water, being directed to the immediate proximity of the drain opening facilitates breaking of the debris accumulated in that area and clearing of the drainage opening.

It is envisioned that the hose 16 can be manufactured as a spiral hose, and that other flexible tubing can be made from a similar material so as to minimize clutter in the limited confines of a modern bathroom. The cleaning device 10 can be easily connected/disconnected either by hand or by using standard plumbing instruments, and can be sold as a unit with different attachments, or with one attachment, as desired.

The length and shape of the handle 18 can be easily modified either by the manufacturer or the user to accommodate requirements of the user.

FIGS. 10–18 illustrate improvements that have been made in the system of the present invention that was discussed in FIGS. 1–9 above. The improvements as will be described below provide for a system that is easily mountable onto an existing toilet, and allows for more efficient use of the system of the present invention, and for easy storage of the present invention when not in use.

Turning first to FIG. 10, there is illustrated the hygienic device 200 which as was described earlier, includes a nozzle assembly portion 202 with a spray head 204, the nozzle assembly portion 202 mountable on a rigid hollow shaft 207, with a grip portion 208 to be held by the user of the apparatus. Rigid hollow shaft 207 may be loosened in its connection to the handle and rotated 180 degrees in its mounting to handle 208 so as to accommodate either right handed or left handed persons. It is detachably secured to handle 208 as it is mounted on the assembly. Water flowing through tube 207 to nozzle 204 is manually controlled by control handle 210 as is done in the original embodiment. Turning now to the improvements in the system, there is illustrated a water inlet line 212 which would deliver water from the water source of the home into the improved assembly 214. Improved assembly 214 includes the water control knob 216, where there is mounted an elongated threaded nut 218 which threads on its first end to the supply line 220 and on its second end to an upper flow line 222. Flow line 222 threadably engages to a second elongated nut 224 having a first upper outlet 226 for threadably engaging to a flexible water line 228 which extends upward to a third elongated nut 230 (FIG. 11) with a nut 230 (FIG. 11) threadably engaging into the water tank 231 of a toilet as in seen in FIGS. 13A and 13B.

Figure 10A:
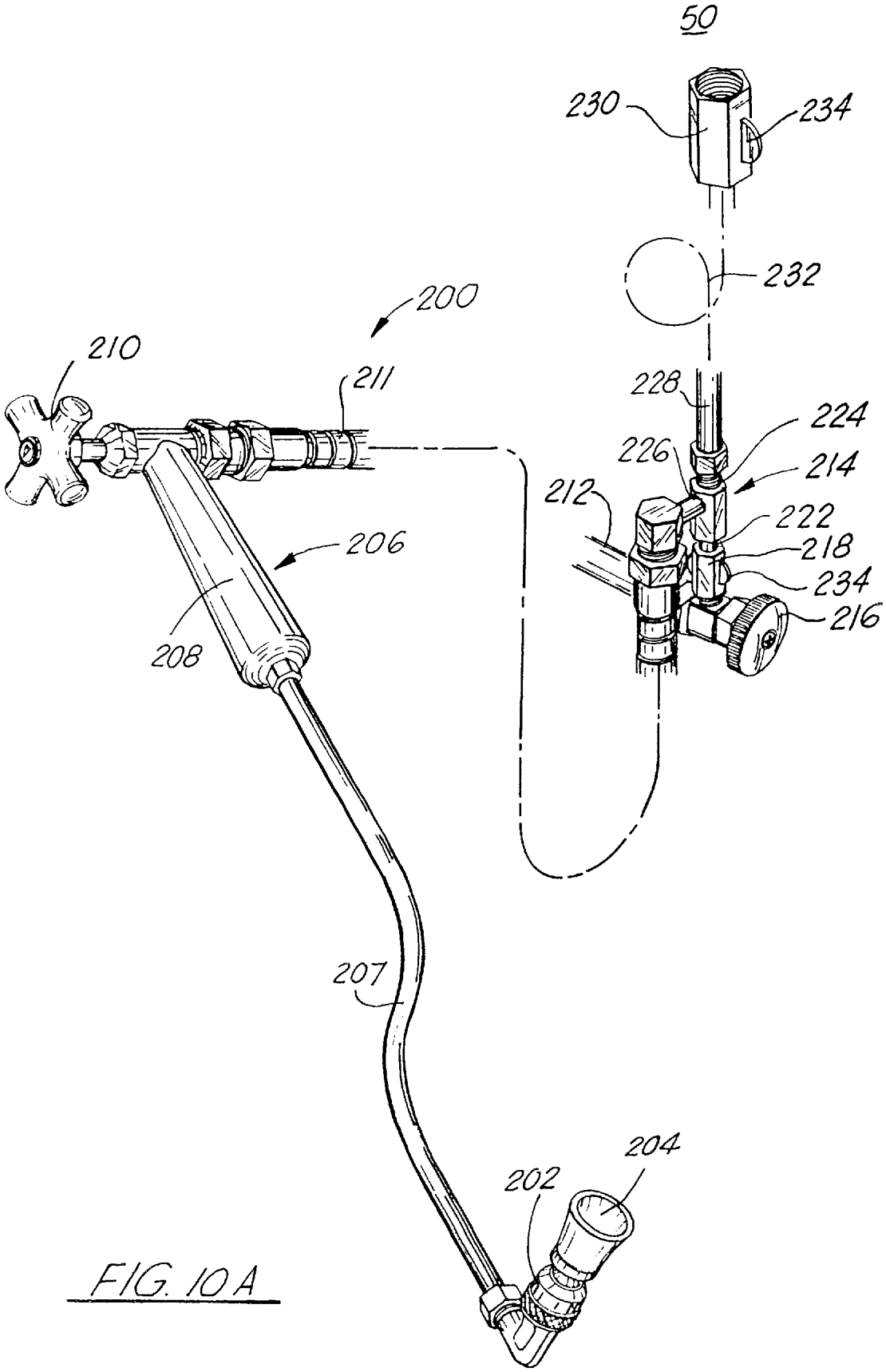
FIG. 10A illustrates an improved mounting assembly utilized with the hygienic device in accordance with the present invention.

As seen in FIG. 10A, the line 228 is able to form a loop 232 as illustrated in phantom view so that it may be accommodated on the various sizes of toilets and its ability to loop confines it within a certain space between the water source and the lower end of the toilet tank 231. It is further illustrated in FIG. 10A that the elongated nuts 218 and 230 are provided with a pair of wings 234 with the wings 234 providing for ease in rotating the nuts in threadably engaging and disengaging the nuts from the assembly. Therefore, the composite assembly as seen in FIG. 10A would allow that when the handle 210 is turned off, that water flow would continue up into the toilet tank 50 uninterrupted by any use of the apparatus. However, it should be known that because the volume of water supplied to toilet tank 231 is so much greater than the apparatus utilizes when functioning as a bidet, the toilet tank 231 refills virtually unimpeded while the apparatus is being utilized. Therefore, when one wishes to use the apparatus in the manner as was described earlier, one would simply hold the apparatus via handle 208 and open control valve 210 for allowing water to flow through flow line 207 into the nozzle assembly 202.

Figure 10B:
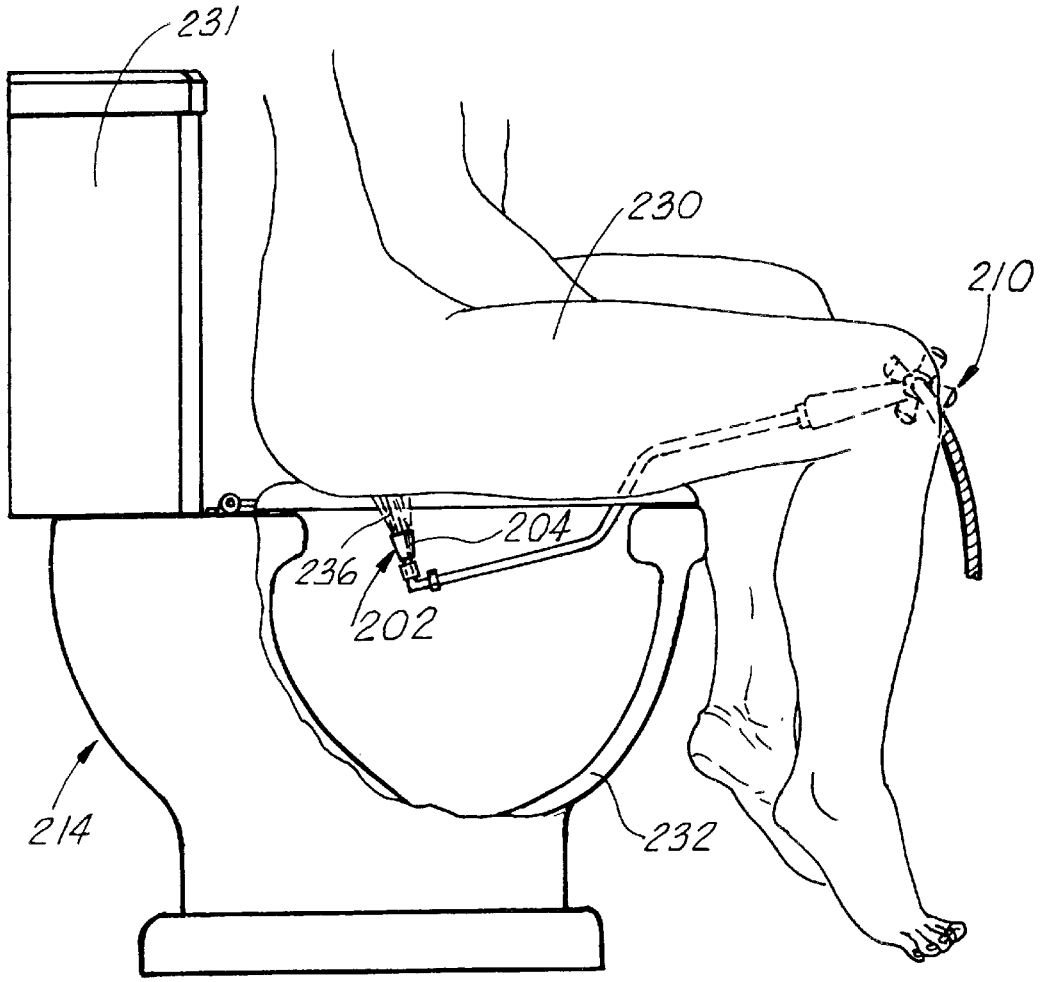
FIGS. 10B and 10C illustrate the invention in use as a personal hygenic device and a device for clearing clogged drain, respectively.
Figure 10C:
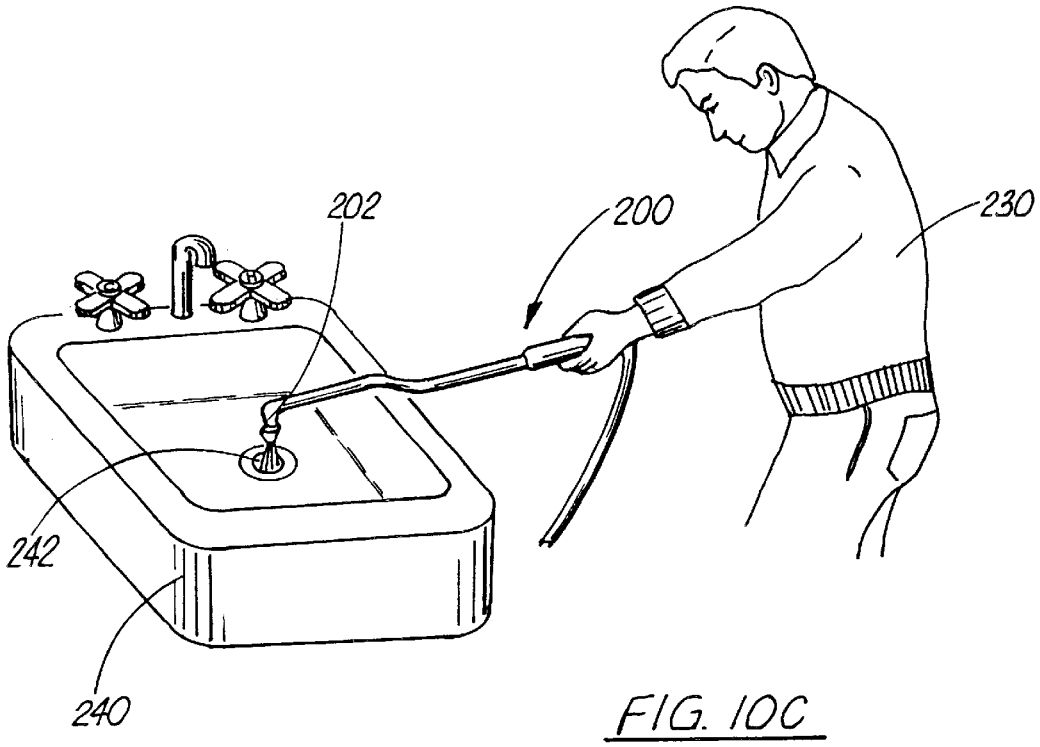

As illustrated in FIG. 10B, a person 230 is illustrated seated upon a toilet fixture 214, wherein the person 230 his holding the improved hygenic device 200, with the nozzle assembly 202 with nozzle 204 positioned beneath the person, in the toilet bowl 232, to produce a spray of water 236 onto that portion of the person 230 to be cleaned. The device 200, as illustrated would be manually operated by the person 230 during cleaning, and would be activated by the person via knob 210. As seen in FIG. 10C, the device 200 is shown with a person 230 directing the spray from nozzle assembly 202 into a lavatory fixture 240 to assist in, for example, unclogging the drain 242 thereof.

Figure 11:
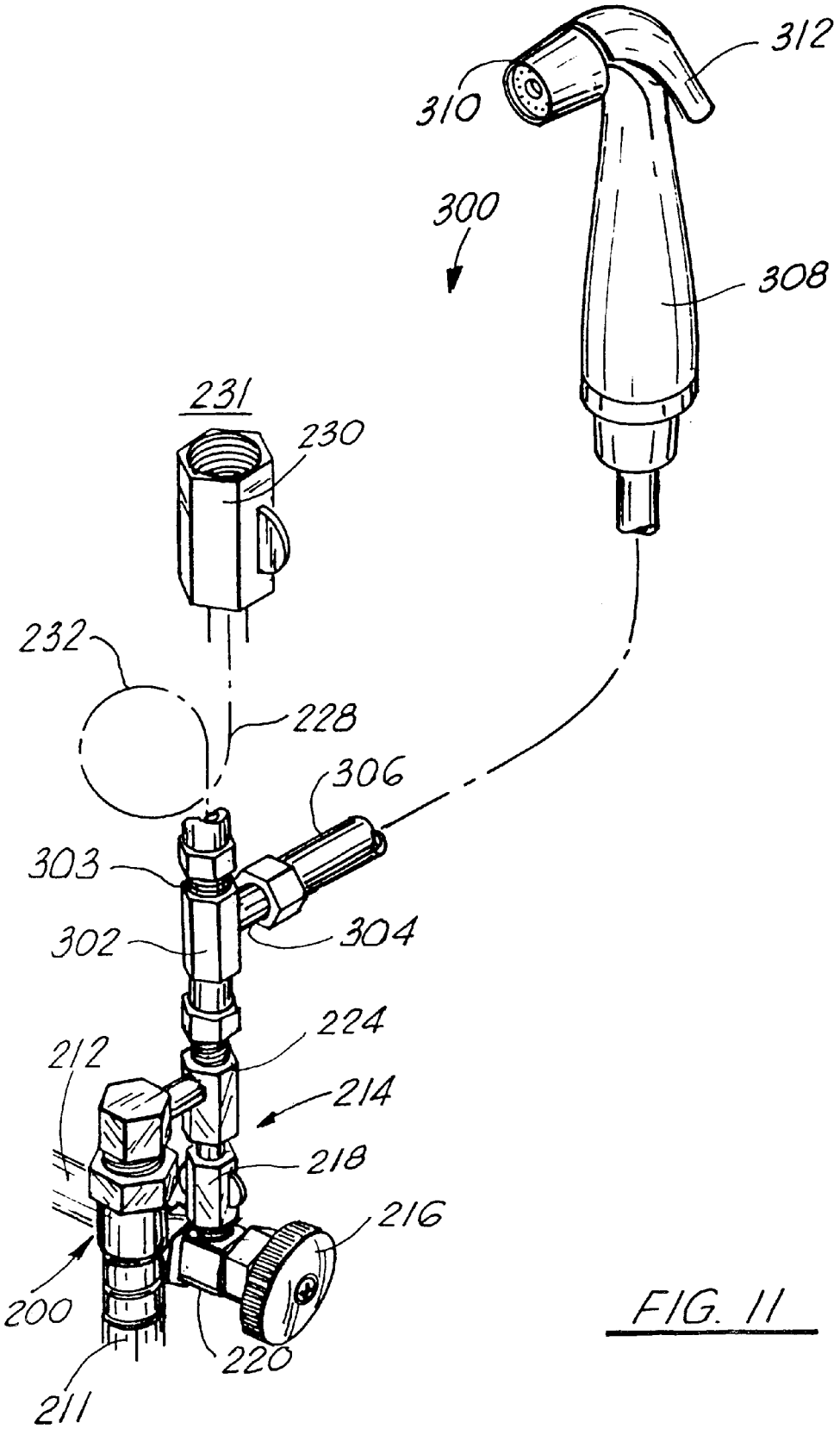
FIG. 11 illustrates the improved mounting assembly for the hygienic device provided with a spray head nozzle suitable for use during diaper changes in the present invention.
Figure 12C:
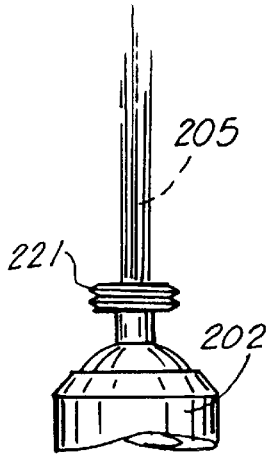
FIGS. 12A–12C illustrate views of the cleaning nozzle assembly illustrated in FIG. 10 of the present invention.
Figure 12A:
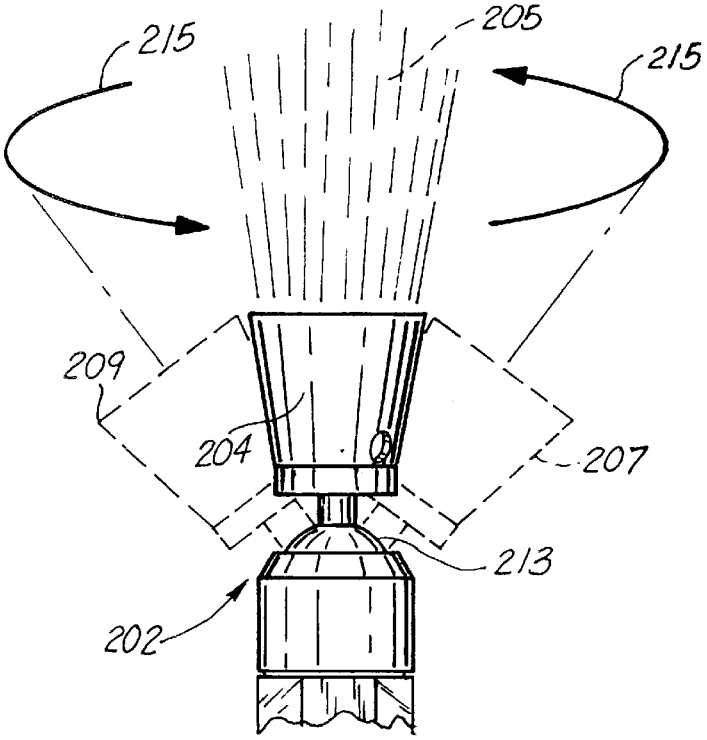
Figure 12B:
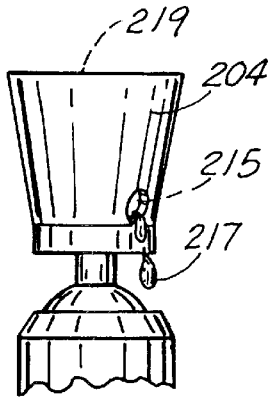

Prior to a discussion of the alternative embodiment of the improved assembly with use with a spray head as seen in FIG. 11, reference is now made to FIGS. 12A–12C where there is illustrated the nozzle assembly 202 as was discussed previously, having the nozzle 204 for emitting a water spray 205 as illustrated. As seen in FIG. 12A, assembly 202 includes the nozzle head 204 mountable such that it is movable between a first position (phantom view) 207 to a second position 209 on a ball and socket joint 213, so that the nozzle 204 is able to rotate over a circumferential path as illustrated by arrows 215. In this manner, the nozzle 204 is able to clean over a large area when in use. As seen in FIG. 12B, nozzle head 204 includes an opening 215 which allows for any water 217 which may have accumulated within the cavity 219 of nozzle 204 to flow therefrom so that there is no fluid held within cavity 219 after it is used. Further, port 215 prevents accidental over pressurization of a person's body cavity while held tightly against the orifice of that cavity by allowing fluid to flow therethrough. In FIG. 12C, the nozzle assembly 202 is illustrated with the head 204 having been threadably disengaged from threads 221, so that rather than the broad spray of water 205 as seen in FIG. 12A, the spray of water 205 becomes a direct thrust, the reasons for which will be described further. It should also be known that the apparatus is the only product that, with the spray head attached, is designed to provide or deliver a non-invasive enema.

Figure 13A:
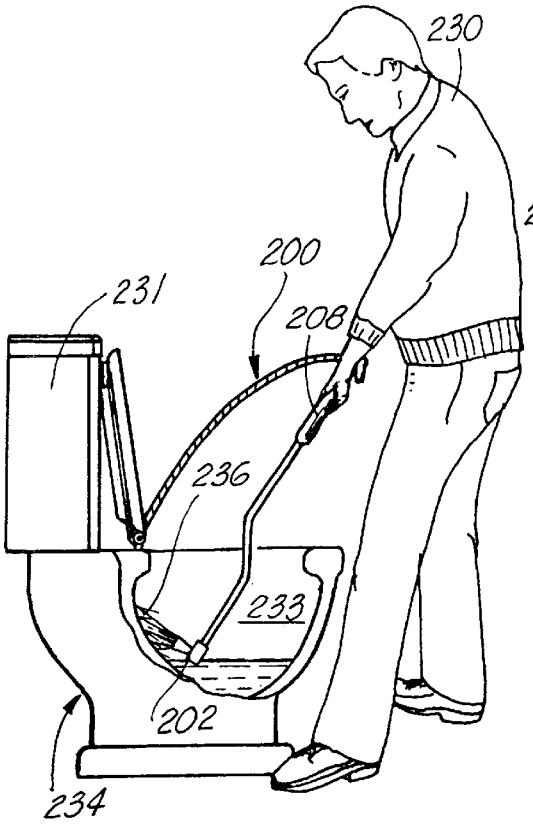
FIGS. 13A and 13B illustrate the hygienic device of FIG. 10 utilized for cleaning a toilet bowl or unstopping same.
Figure 13B:
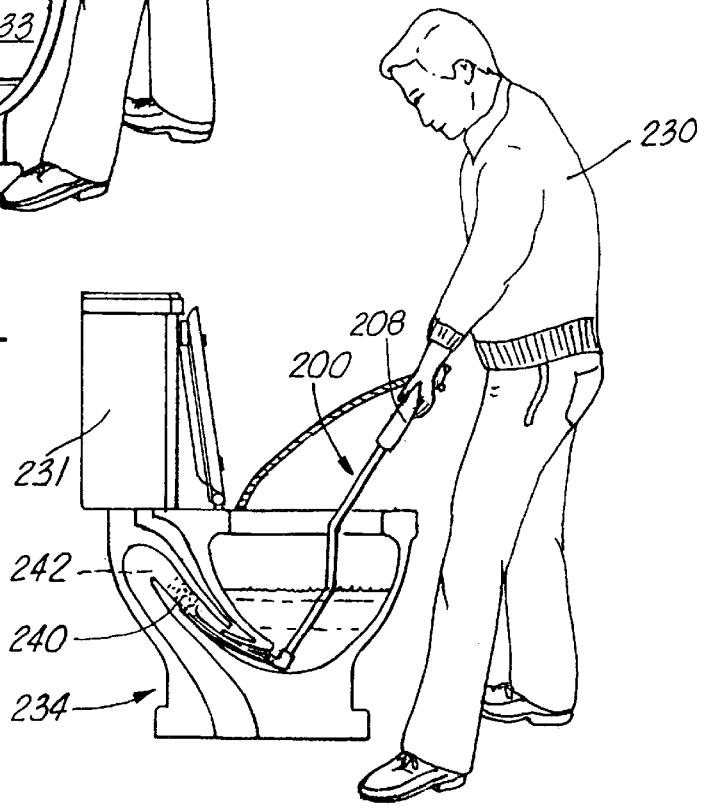

Turning now to FIGS. 13A and 13B, as seen in 13A the apparatus 200 is being held via handle 208 by a person 230 and while cleaning the bowl 233 of a toilet 234 as seen in FIG. 13A. As illustrated, the nozzle assembly 202 is directed outward or sideways onto the rear wall 236 of the toilet bowl 233, for cleaning away any debris which is thereupon. However, as seen in FIG. 13B, there is illustrated the toilet bowl 233 wherein there may be a blockage 240 in the outflow channel of the toilet bowl 233. Therefore, in order to emit a more forceful flow of water 205, the nozzle head 204 has been moved from the assembly 202 as illustrated in FIG. 12C, and therefore a direct thrust of water is emitted from the nozzle assembly 202 thus clearing the blockage from the flow path 242 and thus allowing the toilet 234 to flush easily.

Figure 14:
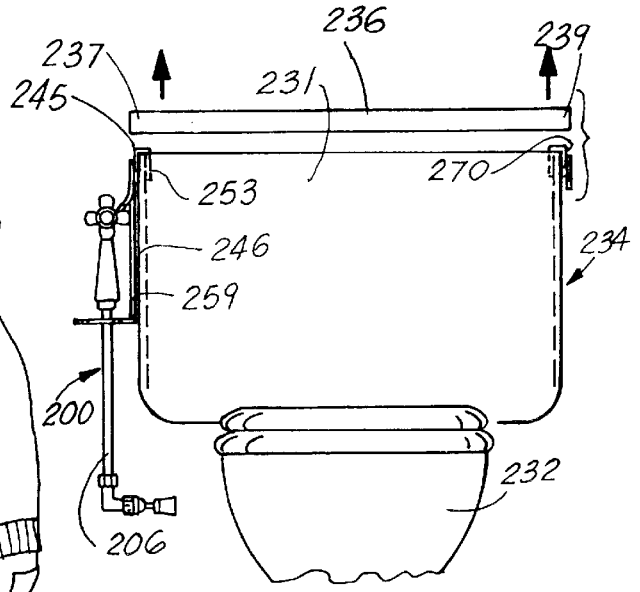
FIG. 14 illustrates a frontal view of the support bracket and its mate mountable on a toilet tank in the present invention.

Because the cleaning assembly as was discussed earlier in relation to FIG. 10A, is able to be mounted permanently onto a toilet 234, it is beneficial that the assembly be allowed to be stored in a convenient yet unobtrusive place adjacent the toilet 234 when not in use. Therefore, reference is made to FIG. 14, where there is illustrated the toilet 234 showing the toilet bowl 232 and the toilet tank 231 which is a typical toilet where the toilet tank includes a lid 236 thereupon which is liftable for access into the tank 231. As illustrated in FIG. 14, reference is made to a hanger 245. Hanger 245 is illustrated more clearly in FIG. 15 and includes an elongated central body portion 246 having an upper toilet mounting portion 248 and a lower support portion 250 for supporting the assembly 200 thereon. As illustrated, the support portion 248 includes a pair of upper arms 249, 251 extending outward from the body portion 246, each of the arms for engaging a first lip 253 and a second lip 255 (FIG. 15), each of the lips 253, 355 forming a space 257 sufficiently wide for engaging onto the wall 236 of the toilet bowl 231 as illustrated in FIG. 14. As further illustrated, arm 251 includes an angulated lower extension 259 terminating in a finger 260 extending outward from the arm 251 which would be utilized for resting the control knob shaft 210 thereon while the apparatus 200 hangs vertically therefrom as seen in FIG. 14. In order to insure that apparatus 200 hangs completely vertical, the lower portion 250 of hanger 245 includes a first elongated arcuate arm 260 and a second arcuate portion 262, each for defining an opening 264 therein so that the tube 207 of assembly 200 may hang therein and rest along the inner wall 263 of arcuate portion 262 while not in use. Therefore, as seen in FIG. 14, the hanger 245 is engaged to the wall 259 of bowl 231 via lips 253, 255, with the body 246 resting along the outer surface of toilet bowl wall 236 and with the assembly 200 hanging thereupon in vertical fashion in an unobtrusive, yet convenient location for grasping by a person who may want to use the device in conjunction with the toilet 234. It should be noted that for purposes of construction when the upper lid 236 is replaced up upon the tank 231, because of the lifts 253, 255 hanging over the upper edge of the wall, a first end 237 of lid 236 would be slightly raised as opposed to the second 239. Therefore, there is provided a second equalizing member 272 which could be placed on the edge of the wall 259 of toilet bowl 231 so as to provide that lid 236 is resting at a complete horizontal orientation rather than slightly lifted on its first edge 237.

Turning now to an additional improvement in the preferred embodiment of the apparatus, as was discussed earlier, the hygienic apparatus 200 as illustrated in FIG. 13A is often utilized for cleaning a toilet bowl 234 as illustrated. However, due to the fact that when this is done in order to avoid water splashing out of the bowl onto the floor of the bathroom, the toilet seat would be accommodated with a sealing gasket as was described earlier in FIG. 3 of the original embodiment. The sealing gasket would therefore allow that any water that would flow out of the bowl would make contact with the gasket but would not flow out of the toilet and return into the bowl. The improvement that has been made is the fact that when a sealing gasket is placed on a toilet seat, there must be a flow line through the gasket so as to allow flow of air into the toilet bowl when the toilet is flushed and a person is seated thereupon. In the original embodiment, the original embodiment did teach air vents 106 for allowing such flow. However, one of the drawbacks was the fact that although air could flow into the toilet as the water was moved out of the toilet bowl during flushing, foul air that may be accumulated during use of the toilet could likewise flow out of the toilet bowl through these air vents.

Figure 17A:
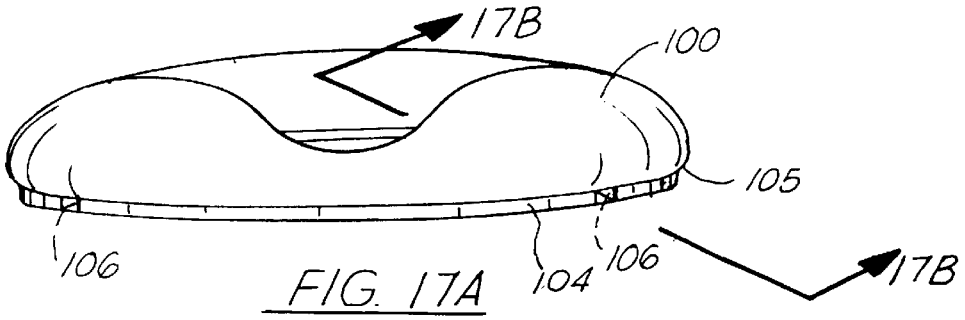
FIGS. 17A and 17B illustrate the improved toilet seat gasketing feature in the improved assembly of the present invention.
Figure 17B:
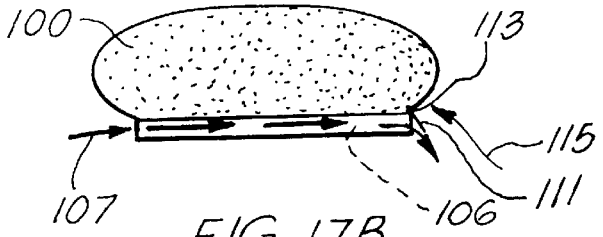

Therefore, reference is made to FIGS. 17A and B where there is illustrated the toilet seat 100 as was seen in FIG. 3 with the indenture 102 having the sealing gasket 104 around its peripheral edge 105 and the air vents 106 in either side of the toilet seat as illustrated. As seen in FIG. 17B, in cross section, the toilet seat 100 is illustrated with the flow vents 106 therethrough and with the arrows 107 showing the flow of air. However, there is further illustrated a one way valving element 111 which is attached at the inner end 113 of each of the flow channels 106 so that air flow (arrows 107) may flow into the toilet bowl in the direction as illustrated in FIG. 17B. However, when the air would seek to return through the vent in the direction of arrow 115, the valve 111 which would normally be shut would remain closed against the flow of air in the direction of arrow 115 and therefore any air within the toilet bowl would be trapped therein so as to reduce the flow of fowl air out of the toilet bowl into the bathroom.

Figure 16A:
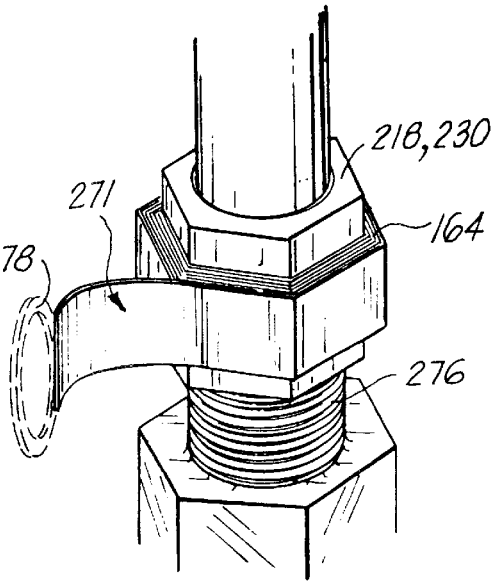
FIGS. 16A and 16B illustrate a mounting nut modified for easy threading for use in the improved assembly of the present invention.
Figure 16B:
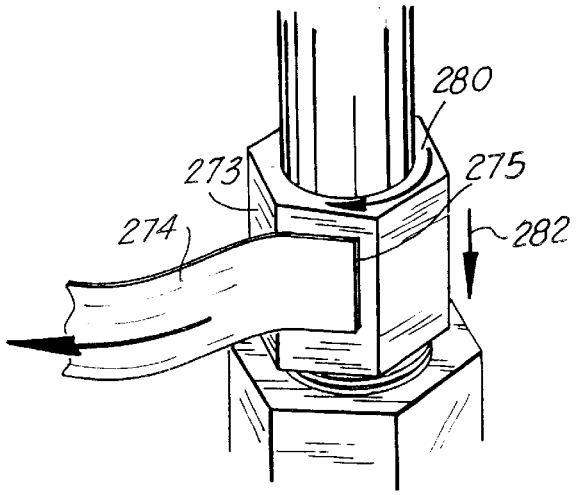

An additional improvement is illustrated likewise in FIGS. 16A and 16B. As was discussed earlier, in relation to FIG. 10, there is included a pair of threadable nuts 218 and 230 which are utilized in the mounting of the assembly onto an existing toilet. Returning to FIG. 10, it is seen that the nuts 218, 230 are elongated in length for easy grasping and include wings 234 which enable a person to easily thread it on and off. Yet another improvement which has been made which is an alternative to wings 234 is a tab 271 which is secured on its first end 275 to the outer wall 273 of nuts 218, 230, the tab having an elongated flexible length 274 which is wrapped around the nut 218 or 230 a number of times as illustrated in FIG. 16A, and secured or adheres to this nut by means of a prebonded adhesive to the flexible length 274. Therefore, when the nut is placed upon the threaded post 276 of the post, one would grasp a ring 278 at the end of tab 270 and by pulling the tab, the nut would rotate in the direction of arrow 280 as seen in FIG. 16B, and the nut would threadably engage onto post 276 in the direction of arrow 282. This therefore would enable a person mounting the system to have the nut in position, pull on ring 278 and have the nut threadably engaged onto the post 278 with a single pull thus eliminating any need for continuous rotation of the nut manually in the mounting procedure.

As was discussed with the principal embodiment, the principal embodiment is likewise able to accommodate a second device in the overall assembly. As was discussed in relation to FIG. 5, there was incorporated a tee connector where one branch of the tee enabled one to secure a cleaning attachment having a spray head on its end, for use for spraying for cleaning diapers or the like as was discussed in relation to further in FIGS. 6, 7 and 8. In the improved embodiment, this cleaning assembly is likewise able to be mounted with the hygienic cleaner 200 also.

Returning now to FIG. 11, again there is illustrated the water flow line 212 where water would flow into the mounting assembly 214 which includes the control knob 216, the mounting member 220, the first engaging nut 218 which would then be secured to the first mounting nut 224 whereby the cleaning assembly 200 would be threadably engaged via line 211. However, as seen in the particular embodiment in FIG. 11, prior to flowline 228 extending upward to the upper mounting nut 230 onto the toilet tank 231, there is illustrated an additional mounting nut 302 which includes a tee member 304 which threadably engages into a flexible line 306 with the flexible line terminating in a spray nozzle 308 having a spray openings 310 and a control lever 312. Like the principal embodiment, after tee 302 has been mounted in the path in the assembly 214, then the line 228 is threadably engaged thereto at its upper end 303 and is then engaged into the toilet tank 231. Therefore, in this assembly, as seen in the FIGURE, one has the use of the cleaning apparatus 200 for performing personal hygiene or for cleaning or unstopping a toilet and yet has a second flow line 306 extending from the principal flow line for including a spray nozzle 308 that can be utilized for cleaning diapers or babies in the fashion as was discussed in relation to FIGS. 5–8. The use of the winged nuts 218, 230 likewise would be accomplished in this embodiment also, together with the option of utilizing the tabs 271 thereon for easy threading onto the system. As further illustrated in FIG. 11, the line 228 is a flexible line and could form loop 232 as was discussed earlier in FIG. 10. If in fact, the nozzle assembly 300 is mounted onto the system as seen in FIG. 17, that nozzle assembly likewise could be secured onto mounting bracket 245 for example, to be maintained out of harms way, and yet easily accessible thereto. Of course, if neither the cleaning device 200 or the cleaning device 300 were in use, then the toilet could simply be utilized in the standard manner since water would flow directly through water supply line 212 through water line 228 into tank 231 for supplying water thereto, as is done with a normal toilet.

Figure 18:
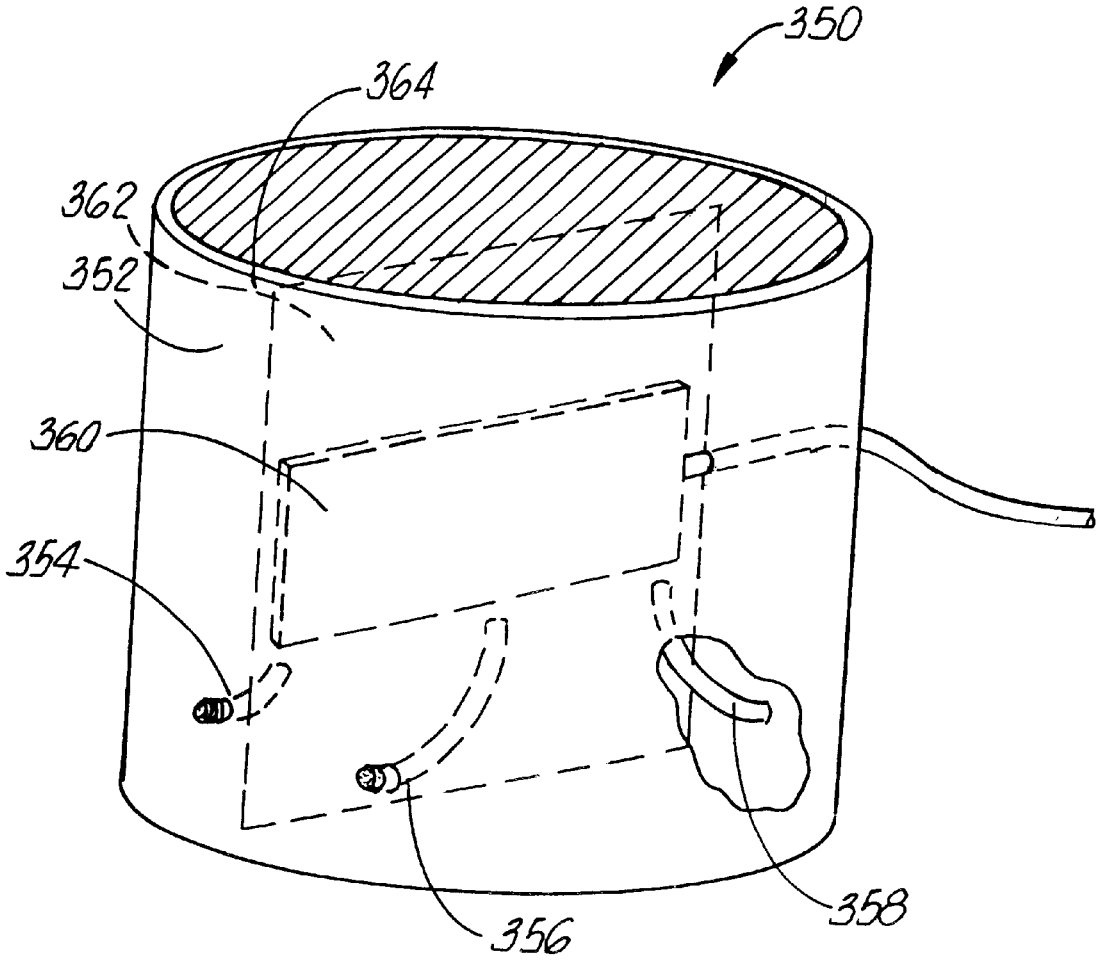
FIG. 18 illustrates a water warming tank which may be utilized in the improved embodiment of the present invention.

A final feature which is contemplated is the use of a heated or ambient temperature water supply equalization chamber 350 as illustrated in FIG. 18. As illustrated, the chamber 50 could rest on the floor behind the toilet which would include a water tank portion 352 having a water inlet line 354 and a first outlet line 356 which would return water to the hygienic apparatus line 200 and a second outlet line 358 which would return water to the diaper rinse assembly 300. Further, outlet 358 can also be used for mounting cleaning device 200 on the left side of the toilet tank 231 to better accommodate left handed users of the apparatus. Water would flow into tank 352 and would be heated via a heating element 360. The water would be maintained and there would further be included an internal temperature change buffering divider panel 362 extending across the entire width of the tank 352 so as any water flow occurring within tank 352 from the inlet line to the exit lines would flow over the upper edge 364 of panel 362, so as to assure that it is of a particular predetermined temperature.

Figure 15:
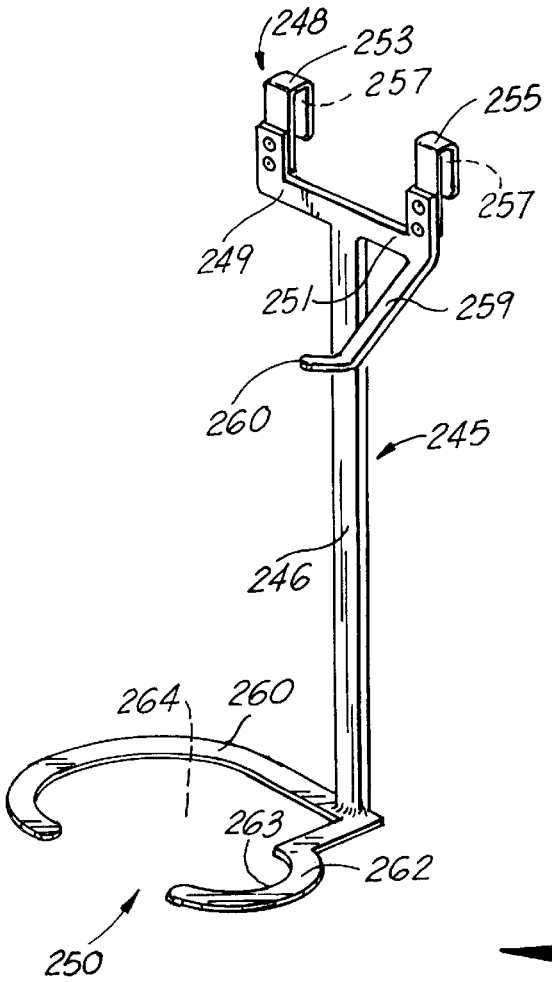
FIG. 15 illustrates an overall view of the improved mounting bracket of the present invention as illustrated in FIG. 14.

In the mounting of the tank 352, it is foreseen that the capacity chamber could be mounted onto the side of the toilet bowl 231 and include a hanger similar to the hanger shown in FIG. 15 to store apparatus 200 when not in use. This arrangement would provide for more convenient access to apparatus 200 while not being used.

Figure 19A:
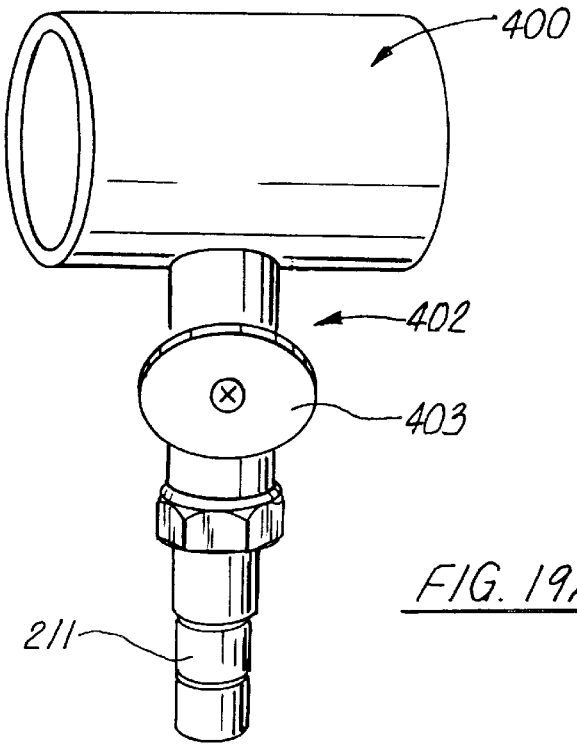
FIGS. 19A–19C illustrate the improved mounting assembly of the present invention utilized with a commercial type toilet or female urnal without a tank portion.
Figure 19B:
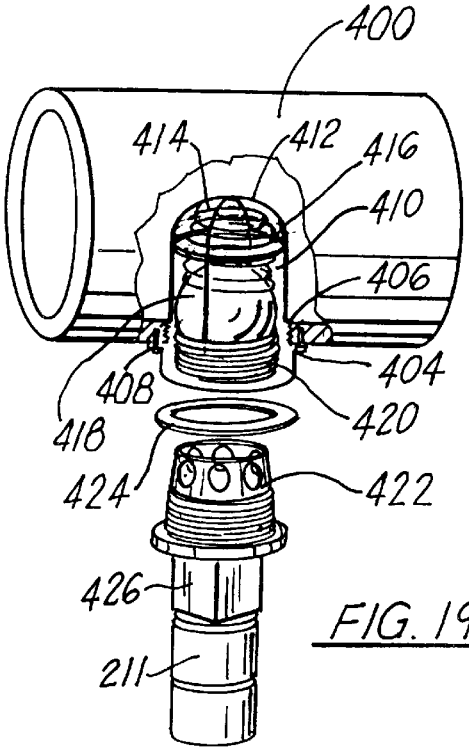
Figure 19C:
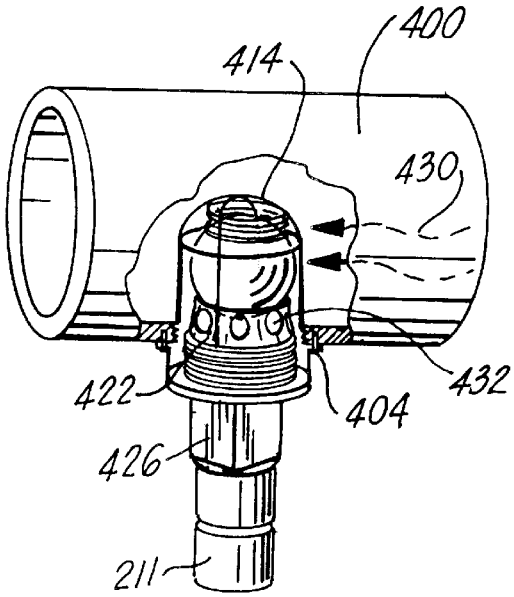

FIGS. 19A–19C illustrate an adaptor for allowing the apparatus 200 to be used with a commercial type toilet of the type simply having a pipe section extending outward from the wall for supplying water directly to the toilet apparatus rather than through a toilet bowl. As seen in FIG. 19A, there is illustrated a water flow pipe 400 which has been adapted with a water supply valve section 402, of the standard type having a water flow control valve 403 so that when the valve is open, water may flow into line 211 of apparatus 200 which could be used directly off of water flow line 400. FIGS. 19B and 19C illustrate a modified version of valving member 402 as seen in cut away view. As illustrated in those Figures, the modified valving section 402 includes an upper portion 404 which has been tapped into a bore 406 into pipe 400 and is secured thereto via pins or screws 408. The upper section includes a flow chamber 410 which includes a cap portion 412 housing a spring 414, a separator 416 and a ball or plug 418. The self sealing plug valve 404 includes internal threads 420 which would threadably engage the lower male portion 422 of valving member 402. The member 422 as seen in FIG. 19C after threadably engaged would be sealed in place via sealing gasket 424 and would have on its lower end a removable collar 426 onto which the flexible hose 211 of system 200 would be engaged.

Turning now to FIG. 19C, after member 404 is threadably engaged into the upper portion 406, the head 422 makes contact with the ball 418 and pushes the ball 418 into the position against the bias of spring 414 as illustrated. When that is accomplished, flow through the pipe 400 as seen by arrows 430 is allowed to enter the various ports 432 in member 422 and flow into flow line 211 in order to supply water to apparatus 200. Therefore, when the mechanism is used in the manner as illustrated in FIGS. 19B and 19C, the removable collar 426 can simply be engaged and disengaged and when it is engaged, ball 418 is pushed into a sealing position by spring 414 as illustrated in FIG. 19B and when it is re-engaged as illustrated in FIG. 19C, the ball is pushed upward into the cavity and flow is then allowed through line 211.

The foregoing embodiments are presented by way of example only; the scope of the present invention is to be limited only by the following claims.

What is claimed is:

1. A cleaning device, for use with a personal hygiene toiletry fixture of the type having at least a bowl portion, and a source of fresh water supplied to the toiletry fixture through a valving element, the cleaning device comprising:

an elongated flexible tubing having two ends, one end of the tubing adapted for connection to the valving element through which the source of water is supplied to the toiletry fixture;

a rigid hollow handle to be held by a user of the device mounted in fluid communication with a second end of said tubing;

a flow control valve mounted between said second end of said tubing and said handle for manually regulating a flow of water from said source of water through said handle by a user of the device;

a cleaning attachment detachably securable to a free end of said handle for receiving the flow of water through said handle and emitting a flow of water from said cleaning attachment as the cleaning attachment is hand held by the user;

said cleaning attachment further comprising a spray head rotatable around substantially a 360 degree arc, for directing a wide spray or concentrated spray of water as desired by a user; and further comprising an elongated pipe having an open free end, supporting said spray head, said spray head being removable from said pipe, for delivering a concentrated stream of water to clogged drain opening to thereby facilitate clearing of the drain opening; and an improved mounting assembly for placing the device onto the toiletry fixture, said mounting assembly including manually threadable members for efficient engagement onto an existing toiletry fixture water inlet line.

2. The device of claim 1, further comprising a support stand for supporting said cleaning device on a vertical structure, said support stand further comprising a first bracket shaped to retain said handle in vertical suspension and provided with a unitary extension adapted for resting on a top rim of the toiletry fixture; and a second bracket for supporting a top of the toiletry fixture in a horizontal position.

3. The device of claim 1, wherein said spray head further comprises a plurality of openings carried by a curved connecting member, said connecting member retaining said spray head to said handle so as to direct a flow of water exiting through said openings upwardly when the cleaning device is in use.

4. The device of claim 1, further comprising a secondary cleaning unit adapted for connection to the source of water supplied to the toiletry fixture independently from said flexible tubing.

5. The device of claim 4, wherein said secondary cleaning unit comprises a flexible hose carrying a hand-held spray nozzle, said spray nozzle being provided with a spring-operated control lever for regulating a flow of water through said spray nozzle.

6. The device of claim 4, wherein said secondary unit further comprises an open top housing adapted for positioning over a toilet seat and sized to accommodate an infant being cleaned with water delivered through said spray nozzle.

7. A cleaning device, for use with a toilet of the type having a tank portion and a bowl portion, and a source of fresh water supplied to the tank portion through a valving element, the cleaning device comprising:

an elongated flexible tubing adapted for connection at a first end to the source of fresh water supplied to the tank portion through the valving element;

a rigid hollow handle mounted at a second end of said flexible tubing in fluid communication with said tubing, said rigid hollow handle having a discrete length sufficient for extending said handle by a user from a point outside of a toilet seat to a distance above a toilet bowl when the user is using the cleaning device in cleaning the user while seated on the toilet bowl;

a flow control valve mounted between said tubing and said handle for regulating a flow of water through said handle, said control valve being located in front of the toilet bowl when the cleaning device is in use;

a cleaning attachment detachably securable to a free end of said handle, said cleaning attachment comprising a spray head having a first portion for allowing a wide flow of water from said spray head for cleaning the toilet bowl, and upon removing said first portion, said spray head emitting a concentrated flow of water from said spray head for facilitating flow from said toilet bowl during flushing;

an improved mounting assembly for mounting said device between a water flow line to said toilet bowl and said toilet bowl, said mounting assembly including manually threadable members for efficient engagement onto an existing toilet water inlet line; and a pair of brackets, each having an extension for supporting said cleaning device independently the toilet tank.

8. The device of claim 7, further comprising a secondary cleaning unit adapted for connection to the improved mounting assembly, so that the secondary cleaning unit receives a source of fresh water supplied to the tank portion through the improved mounting assembly, said secondary cleaning unit comprising a flexible hose carrying a hand-held spray nozzle, said spray nozzle being provided with a depressible control lever for regulating a flow of water through the spray nozzle.

9. A cleaning system used in combination with a toilet fixture of the type having at least a bowl portion and a source of fresh water supply to the toilet fixture through a first flow line, the cleaning system comprising:

an improved mounting assembly for mounting said cleaning system onto said first flow line, said mounting assembly including manually threadable members for efficient engagement onto said first flow, line wherein said threadable members further comprise an elongated wall portion with a projection extending therefrom for easy rotation of said members for threadably engaging the members onto said first flow line;

a second fluid flow line extending from said mounting assembly;

a cleaning device detachably securable to a free end of said second fluid flow line, said cleaning device comprising a spray head having a first portion for allowing a wide flow of water from said spray head for cleaning the toilet bowl, and upon removing said first portion, said spray head emitting a concentrated flow of water from said spray head for facilitating flow from said toilet bowl during flushing; and a support stand for supporting said cleaning device on a vertical structure, said support stand further comprising a bracket shaped to retain said cleaning device in vertical suspension and provided with a unitary extension adapted for resting on a top rim of said toilet fixture.

10. The system of claim 9, further comprising a means for sealing a perimeter of a toilet seat mounted on the toilet fixture to prevent escape of water between the toilet seat and a bowl portion of the toilet fixture, said sealing means further comprising a valving element for allowing travel of air only into said toilet bowl.

* * * * *